US007114619B2

(12) United States Patent
Ellis et al.

(10) Patent No.: US 7,114,619 B2
(45) Date of Patent: Oct. 3, 2006

(54) CHILD RESISTANT DISPENSING CLOSURE PACKAGE

(75) Inventors: Douglas Ellis, Neshanic, NJ (US); Aleksey Zats, Fair Lawn, NJ (US); Henry H. Nyman, York, PA (US)

(73) Assignee: Paradigm Packaging, Inc., Carlstadt, NJ (US)

( * ) Notice: Subject to any disclaimer, the term of this patent is extended or adjusted under 35 U.S.C. 154(b) by 110 days.

(21) Appl. No.: 10/799,787

(22) Filed: Mar. 12, 2004

(65) Prior Publication Data

US 2005/0199527 A1 Sep. 15, 2005

(51) Int. Cl.
*B65D 83/04* (2006.01)
*B65D 43/12* (2006.01)

(52) U.S. Cl. ..... 206/540; 206/1.5; 220/345.1

(58) Field of Classification Search ..... 206/528–540; 215/211, 213; 220/254.9, 259.5, 345.1, 345.2, 220/345.4, 351; 221/306
See application file for complete search history.

(56) References Cited

U.S. PATENT DOCUMENTS 2,115,494 A * 4/1938 Lurssen ..... 206/459.5
3,313,441 A 4/1967 Fadden
3,501,041 A 3/1970 Schaefer
3,625,386 A 12/1971 Schaefer
3,759,420 A 9/1973 Karkanen
3,843,008 A 10/1974 Colella
3,860,135 A 1/1975 Yung et al.
3,893,593 A 7/1975 Hazard
3,923,180 A 12/1975 Fields
3,924,768 A 12/1975 Lemons
3,949,899 A * 4/1976 Jacobs et al. ..... 220/345.3
4,127,221 A 11/1978 Vere
4,146,146 A 3/1979 Mar
4,170,724 A * 10/1979 Waterbury ..... 220/345.3
4,358,022 A 11/1982 Geiger
4,458,819 A 7/1984 Geiger
4,462,501 A 7/1984 Franchi
4,469,241 A * 9/1984 Westphal ..... 220/345.2
4,535,903 A 8/1985 Franchi
4,819,829 A * 4/1989 Rosten et al. ..... 220/345.3
4,832,221 A * 5/1989 Manem ..... 215/237
4,860,899 A * 8/1989 McKee ..... 206/534
4,972,657 A * 11/1990 McKee ..... 206/534
5,050,752 A 9/1991 Zoltan et al.
5,188,253 A 2/1993 Poore et al.
5,284,262 A 2/1994 O'Nan
5,400,914 A * 3/1995 Lin ..... 220/254.9

(Continued)

*Primary Examiner*—Bryon Gehman
(74) *Attorney, Agent, or Firm*—Calfee, Halter & Griswold LLP

(57) ABSTRACT

A medicine container includes a child-resistant closure with a tamper-evident feature. The closure includes a plug adapted to be fixed to the container adjacent the open end. The plug has an access opening for enabling removal of material from the container through the open end of the container. A slide is supported on the plug for sliding movement in a first direction relative to the plug between a closed position in which the slide covers the access opening and an open position in which the access opening is uncovered. A child-resistant feature is interposed between the plug and the slide. The closure also includes a tamper-evident feature that permanently indicates breaking of the original seal of the container. The container may have a rectangular configuration including at least one surface large enough for a mailing address label; and a sealable window mailer envelope for receiving the medicine container.

10 Claims, 7 Drawing Sheets

U.S. PATENT DOCUMENTS 5,445,283 A 8/1995 Krautkramer
5,462,189 A * 10/1995 Pierce ..... 220/815
5,971,154 A 10/1999 Toren
6,439,442 B1 * 8/2002 Markert et al. ..... 220/345.1

* cited by examiner

CHILD RESISTANT DISPENSING CLOSURE PACKAGE

TECHNICAL FIELD

The present invention relates to a dispensing package. In particular, the invention relates to a dispensing package including a container, and a closure for the container, for dispensing medication. The closure is child-resistant and tamper-evident.

BACKGROUND OF THE INVENTION

Traditionally, local pharmacists have supplied their patients with prescription mediations in round containers with child-resistant closures. In recent years, pressure to lower medical costs has made it increasingly more common for prescriptions to be dispensed from centralized locations and delivered by mail.

Some centralized prescription facilities have automated the filling process, causing them to abandon the traditional round pill container because of handling problems including capping difficulties and a closure that overhangs the container's body. Today, the package of choice for automated filling locations is a round bottle that accepts a threaded, two-piece child-resistant closure.

One problem with such containers is that the child-resistant closure needs to be fully removed from the container in order to dispense product. This can encourage a patient to leave the cap off, thus making the package non child-resistant. Also, the patient needs to deal with the loose cap while the medication is being dispensed from the container.

There are other improvements that can be made in the automated filling and delivery process. For example, a filled prescription package is typically mailed in a reinforced envelope that must be addressed separately from the medication container; this creates a potential for misdirecting an order. Also, round containers are not "mail-friendly", are cumbersome for a patient to transport in a pocket or purse, and do not store well in medicine cabinets. Required "compliance" labels contain increasingly greater amounts of information, that is difficult to fit onto some round containers. Reading this information is complicated by the fact that a round container needs to be rotated as the information is read.

SUMMARY OF THE INVENTION

The present invention relates to a child-resistant closure for a container having an open end. The closure includes a plug adapted to be fixed to the container adjacent the open end. The plug has an access opening for enabling removal of material from the container through the open end of the container. A slide is supported on the plug for sliding movement in a first direction relative to the plug between a closed position in which the slide covers the access opening and an open position in which the access opening is uncovered. The slide is not removed from the container when the product is dispensed.

In one embodiment, the slide has a plurality of open positions in which the access opening is uncovered to a greater or lesser extent, and the closure includes a retainer for retaining the slide in any selected one of the plurality of open positions.

In one embodiment, the closure further includes a child-resistant feature interposed between the plug and the slide.

The child-resistant feature may include blocking portions that are released in response to the inward pushing force to disengage the blocking portions. The slide may be deformed in response to the inward pushing force.

In one embodiment, the closure includes a tamper-evident feature that permanently indicates breaking of the original seal of the container. The tamper-evident feature may include a detachable portion that moves with the slide from the closed position to the open position during breaking of the original seal of the container and that does not thereafter return with the slide to the closed position.

The invention also relates to a medicine container having a generally rectangular configuration including at least one side surface large enough for placement of a mailing address label; and a sealable mailer envelope for receiving the medicine container, the mailer envelope having a transparent window through which the address label on the container is visible when the container is received in the mailer envelope. This rectangular type of container does not need to be rotated to be read, is easy to mail, and can be stored on edge, like a book on a shelf, for easy readability with other similar containers.

DETAILED DESCRIPTION OF THE INVENTION

The present invention relates to a dispensing package. In particular, the invention relates to a dispensing package including a container, and a closure for the container. The container may be used for dispensing medication, such as prescription medication in the form of pills or tablets. The closure is child-resistant and is also tamper-evident.

Figure 1:
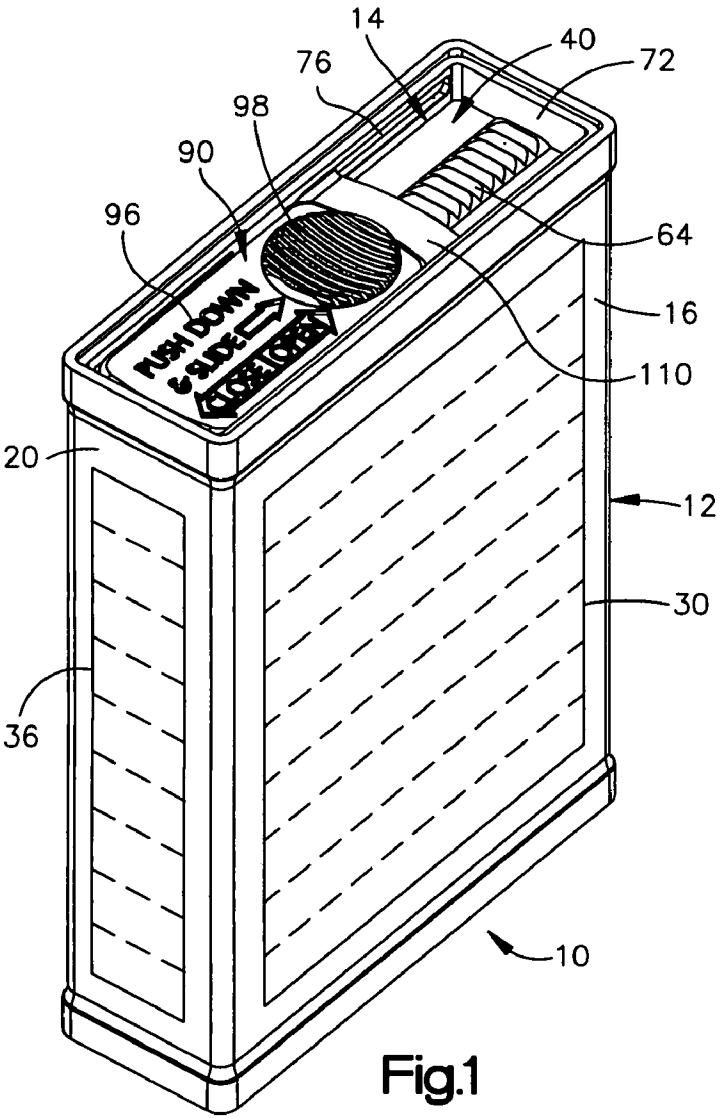
FIG. 1 is a perspective view of a container with closure in accordance with a first embodiment of the invention.

The invention is applicable to packages and closures of varying constructions. As representative of the invention, FIG. 1 illustrates a package 10 in accordance with a first embodiment of the invention. The package includes an open-topped container 12 and a closure 14 for the container.

Figure 2:
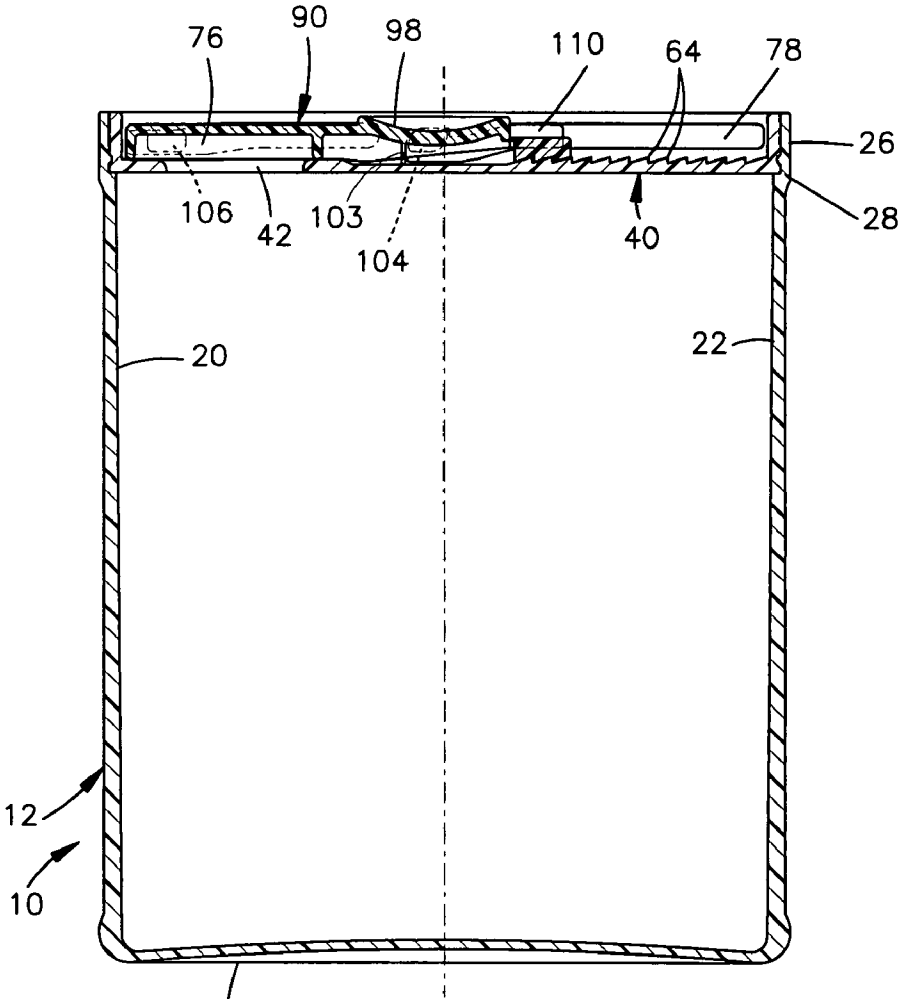
FIG. 2 is a sectional view of the container and closure of FIG. 1.
Figure 3:
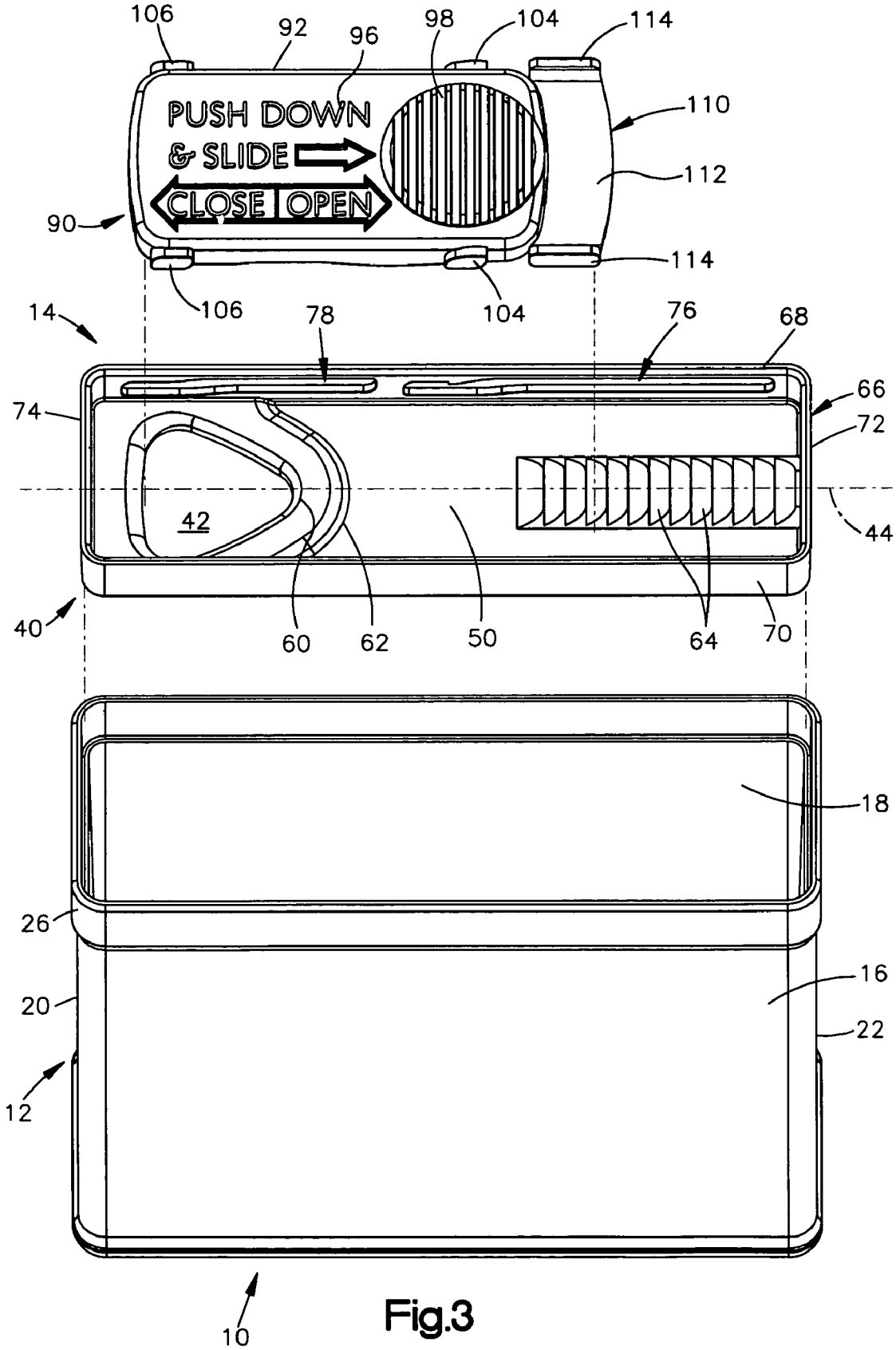
FIG. 3 is an exploded perspective view of the container and closure of FIG. 1.

The container 12 (FIGS. 1–3) has a rectangular configuration including first and second opposite side walls 16 and 18 joined by first and second opposite end walls 20 and 22.

The four walls 16–22 are preferably planar. The container 12 also includes a bottom wall 24 (FIG. 2) that closes one end of the container. It should be understood that the invention encompasses the use of a container 12 having a configuration other than rectangular.

The opposite top end 26 of the container 12 is open. The four side walls 16–22, at the top end 26 of the container 12, bulge outwardly a small amount to form a shoulder 28 (FIG. 2) on the inner periphery of the container adjacent the top end.

In accordance with one aspect of the invention, each one of the flat first and second side walls 16 and 18 is large enough to accept an address label that is suitable for use as a mailing label. As an example, FIG. 1 shows a mailing label 30 attached to the first side wall 16 of the container 12. The mailing label 30 contains all the information needed to deliver the package 10 to the patient through the mails.

Figure 13:
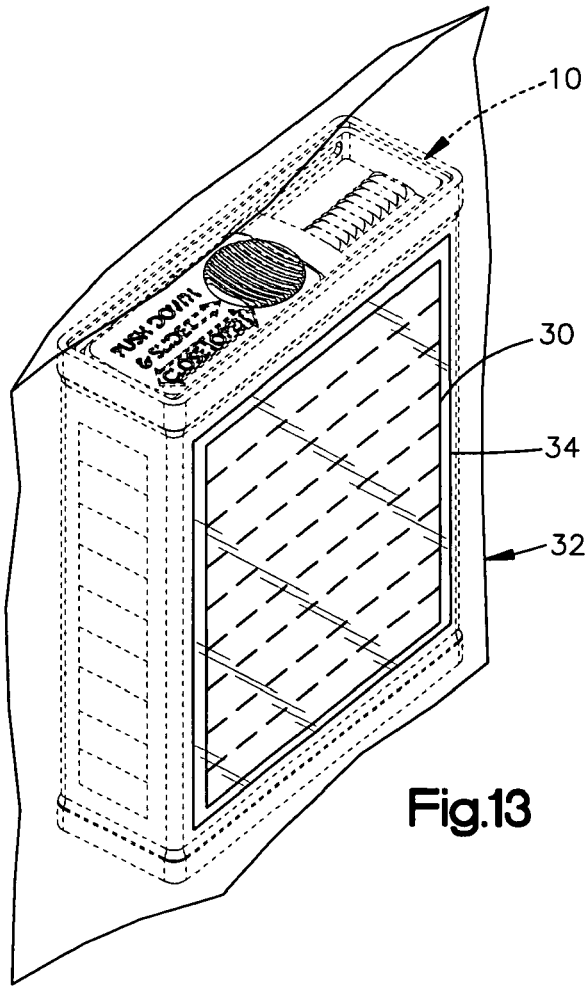
FIG. 13 is a perspective view showing the container and closure of FIG. 1 in a mailing envelope.

FIG. 13 shows the package 10 inserted in a mailer envelope 32. The address label 30 on the package 10 is visible through a window 34 in the envelope 32. The combined envelope 32 and package 10 are quite standard in size and configuration for mail packages. The package 10 is substantially thinner than a round bottle having the medicine same capacity. Therefore, the package 10 is very convenient for mail order prescription filling.

Each one of the first and second end walls 20 and 22 of the container 12 is large enough to accept medicine identification labels, compliance labels, etc. As an example, FIG. 1 shows a medicine identification label 36 attached to the end wall 20 of the container. The label 36 contains all the dispensing information needed by the patient. The label 36 when applied to the container 12 is flat and so is very easy to read, as compared with a label on a round bottle.

In addition, when the package 10 is stood up on its bottom wall 24, like a book on a shelf, the identification label 36 is clearly visible because it is flat. As a result, the container 12 not only can readily accept all the medical information presently found on a round medicine container, but also can readily accept all the delivery information needed to deliver the package 10 to the patient.

In accordance with another aspect of the invention, the package 10 includes a closure 14 (FIG. 3) that includes a plug 40, a slide 90, and a detachable member 110. As described below in detail, the plug 40 is fixed to the open top end of the container 12, and the slide 90 and the detachable member 110 are slidably mounted on the plug, relative to an access opening 42 in the plug.

The plug 40 (FIGS. 3 and 4) is a generally flat, elongate piece with an outer configuration that matches the rectangular configuration of the top of the container. The elongate configuration of the plug 40 extends along a lengthwise or longitudinal axis 44 of the closure.

The plug 40 includes a main body panel 50 having parallel inner and outer major side surfaces 51 and 52. The main body panel 50 extends for substantially the entire extent of the plug 40.

Figure 4:
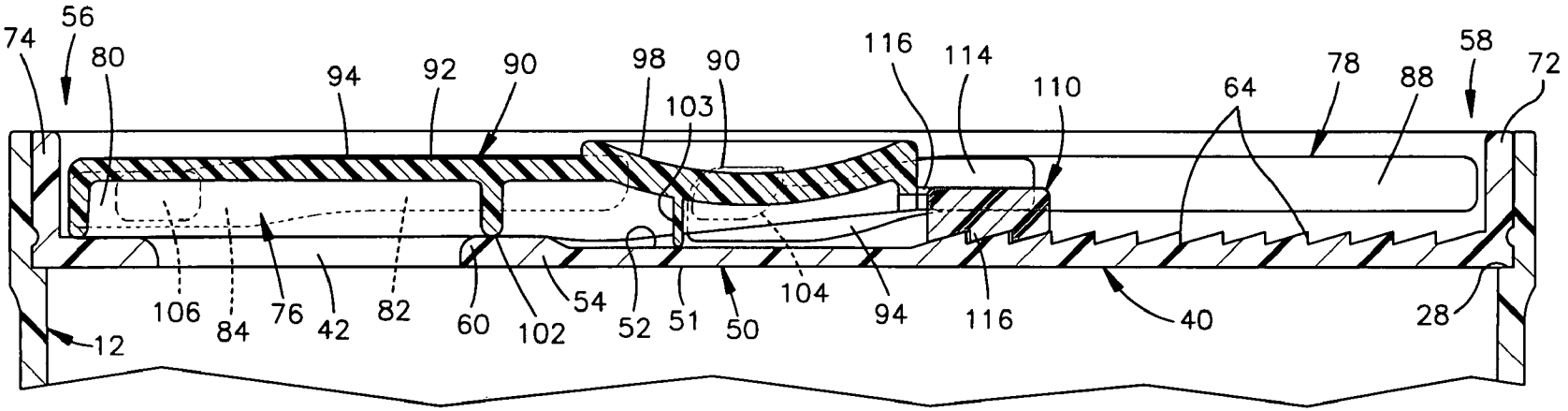
FIG. 4 is an enlarged sectional view of the closure of FIG. 1, shown in a closed condition exhibiting the original seal.
Figure 5:
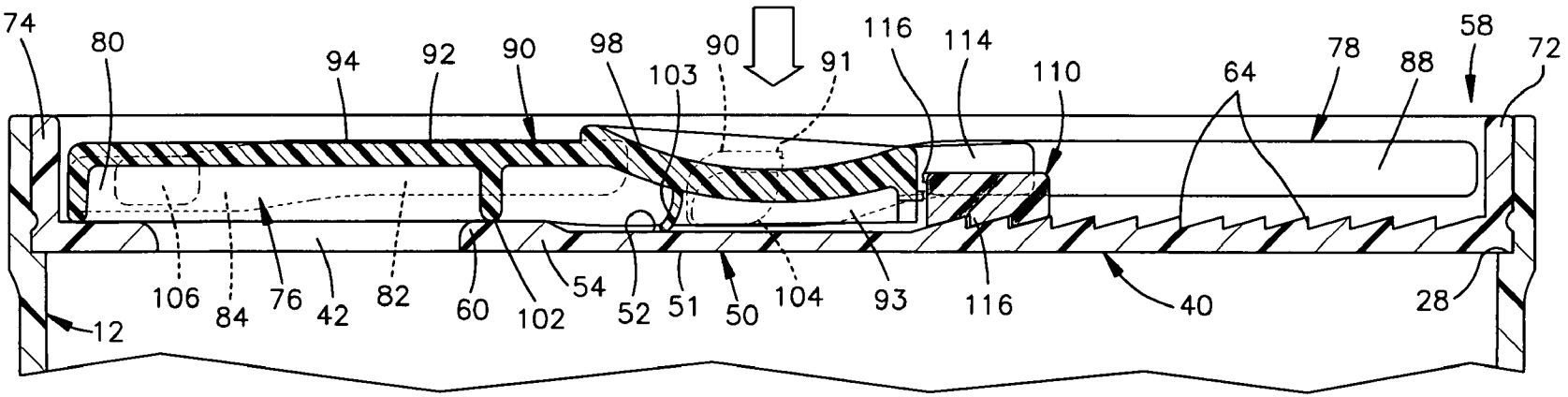
FIG. 5 is a sectional view similar to FIG. 4 showing the closure in a second condition, with force being applied to commence opening.

The main body panel 50 has a thicker portion 54 at its back end 56 (FIG. 4). The thicker portion 54 of the main body panel 50 defines the access opening 42 in the main body panel. The access opening extends between the inner and outer major side surfaces 51 and 52 of the main body panel 50 and provides access to the contents of the container 12 from the exterior of the package 10. In the illustrated embodiment, the access opening 42 has a generally triangular shape pointing toward the front end 58 of the closure 40, although other shapes could, alternatively, be provided.

The main body panel 50 (FIGS. 3 and 4) has a rounded rim 60 that surrounds and defines the access opening 42. The main body panel 50 also has a rounded step 62 between the thicker portion 54 of the main body panel and the thinner remainder of the main body panel. The step 62 has a curved configuration that wraps around the pointed front end of the access opening 42.

The main body panel 50 also includes a plurality of ratchet teeth 64. The ratchet teeth 64 are arranged in a linear array, at the opposite end of the main body panel 50 from the access opening 42. The ratchet teeth 64 do not extend for the full width of the main body panel 50 (from top to bottom as viewed in FIG. 3). As described below, the ratchet teeth 64 are angled to enable movement of the detachable member 110 over them in a direction away from the access opening 42, but not toward the access opening—that is, in a direction from left to right as viewed in FIG. 3.

The plug 40 has a raised rim or flange 66 (FIG. 3) that projects upward from the outer side surface 52 of the main body panel 50. The rim 66 extends completely around the main body panel 50 and includes relatively long first and second side walls 68 and 70 and relatively short front and back end walls 72 and 74.

Each one of the first and second side walls 68 and 70 of the rim 66 includes back and front guidance tracks 76 and 78 (FIGS. 4–7 and FIGS. 8–11). Each guidance track 76 and 78 is formed as a groove in its associated side wall, facing over the main body panel 50 toward the opposite side wall.

On the first side wall 68, the back guidance track 76 is located closer to the back end wall 74 of the plug 40 and is axially coextensive with the thicker portion 54 of the main body panel 50. The back guidance track 76 includes a back portion 80 that is lower (closer to the main body panel 50) and a front portion 82, farther from the back end wall 74, that is higher (farther from the main body panel). A ramp portion 84 of the back guidance track 76 leads upward from the back portion 80 to the front portion 82.

The front guidance track 78 is located closer to the front end wall 72 of the plug and is axially coextensive with the ratchet teeth 64 of the main body panel 50. The front guidance track 78, like the back track 76, includes a back portion 86 that is lower (closer to the main body panel 50) and a front portion 88 that is higher (farther from the main body panel). The back portion 86 of the front guidance track 78 includes an elevated (vertically taller) back end section 90 that is bounded on its front side by a shoulder surface 91. A ramp portion 93 of the front guidance track 78 leads upward from the back portion 86 to the front portion 88.

The front portion 88 of the front guidance track 78 is at the same distance from the main body panel 50 as the front portion 82 of the back guidance track 76. The back portion 86 of the front guidance track 78 is at the same distance from the main body panel 50 as the back portion 80 of the back guidance track 76.

The front guidance track 76 on the second side wall 70 is a mirror image, about a plane through the axis 44 and normal to the main body panel 50, of the front guidance track 76 on the first side wall 58. The back guidance track 78 on the second side wall 68 is a mirror image, about a plane through the axis 44 and normal to the main body panel 50, of the back guidance track 78 on the first side wall 68.

The slide 90 (FIGS. 3 and 4) is supported on the plug 40 for sliding movement relative to the plug in a direction parallel to the axis 44. The slide 90 includes a main body portion 92 that has an outer side surface 94. On the outer side surface 94 of the main body portion 92, indicia 96 (FIG. 3) are formed including directional arrows "Close" and "Open"

and a legend "Push Down and Slide". Adjacent to those indicia 96 is a finger grip 98 which includes a series of ribs or ridges arranged to enable a finger or thumb to firmly engage the slide 90 and transmit force to it in a lateral (sliding) direction as well as a vertical (downward or inward) direction.

Figure 12:
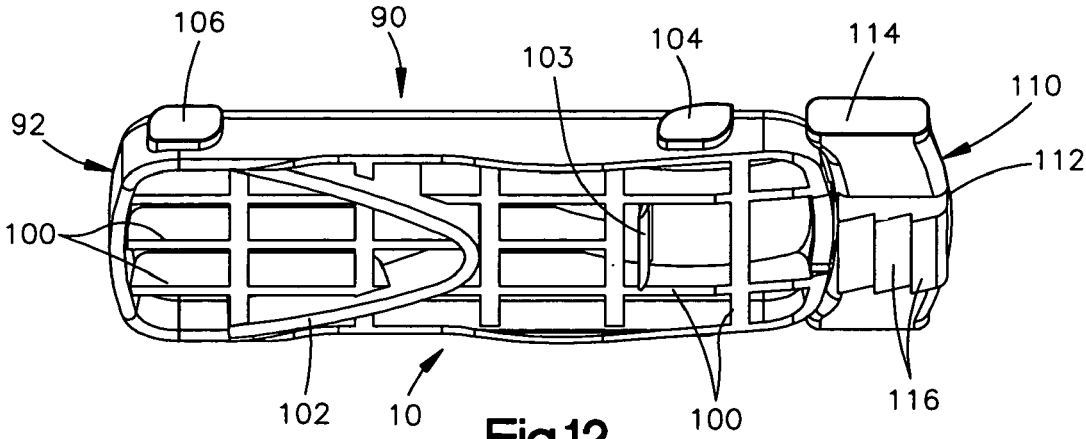
FIG. 12 is a perspective view showing the underside of a slide that forms part of the closure of FIG. 1.

The main body portion 92 of the slide 90 includes a series of ribs 100 (FIG. 12) that project downward in a direction away from the outer side surface. On the ribs 100, a sealing surface 102 is formed. The sealing surface 102 (FIGS. 4 and 12) is substantially the same size and shape as the access opening 42 in the plug 40.

The main body portion 92 of the slide 90 includes a finger 103 (FIGS. 4–12) that projects downward in a direction away from the outer side surface. The finger 103 is adapted to engage the ratchet teeth 64 on the plug 40, as described below, when the slide 90 is moved along the plug.

The slide 90 also includes four tracking pins (FIGS. 3 and 8–11) that engage in the tracks 76 and 78 of the plug. Front and back tracking pins 104 and 106 are located on a first side of the slide 90, and mirror image front and back tracking pins 104 and 106 are located on the opposite second side of the slide.

The detachable member 110 (FIGS. 3 and 4) is formed as one piece with the slide 90. The detachable member 110 includes a central portion 112 that extends for the width of the base panel. The detachable member 110 includes two tracking pins 114 on opposite lateral ends of the central portion 112.

The detachable member 110 is detachably connected with the slide 90 when the slide is formed and before the original seal of the package 10 is broken. In the illustrated embodiment, the detachable member 110 is connected with the slide 90 by two bridges or frangible portions of material 116.

The detachable member 110 has on its underside one or more teeth, or pawls 116, that are engageable with the ratchet teeth 64 on the plug 40. The pawls 116 on the detachable member 110 are oriented to enable sliding movement of the detachable member in one direction only relative to the ratchet teeth 64.

The front tracking pins 104 of the slide 90 (FIGS. 8–11) are received in the front tracks 78 of the plug 40. The back tracking pins 106 of the slide 90 are received in the back tracks 76, respectively, of the plug 40. The four tracking pins 104 and 106 support the slide 90 on the plug 40 for sliding movement along the plug, in a direction parallel to the axis 44, relative to the access opening 42 and to the ratchet teeth 64. The tracking pins 114 of the detachable member 110 are received in the front tracks 78 of the plug 40, forward of the slide 90. The assembly of the plug 40 and slide 90 and detachable member 110 is, thereafter, inserted into the open top end 26 of the container 12 and secured therein to seal, for example, by ultrasonic welding.

Figure 8:
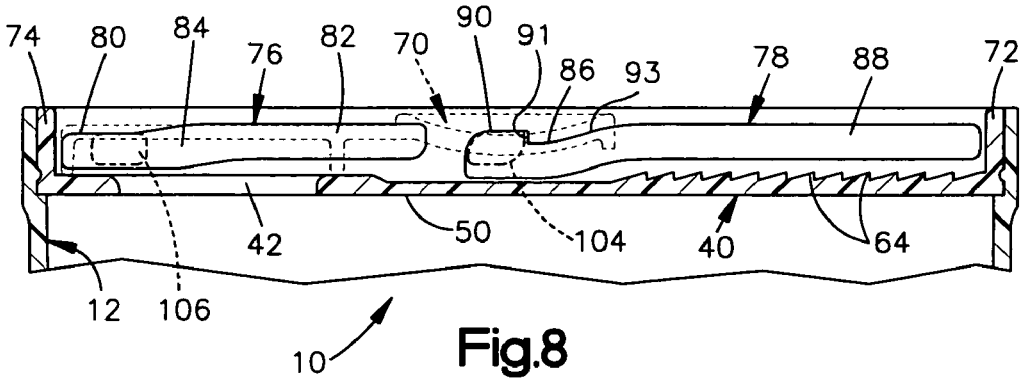
FIGS. 8–11 are a series of schematic views showing guide parts of the closure in sequential conditions.
Figure 9:
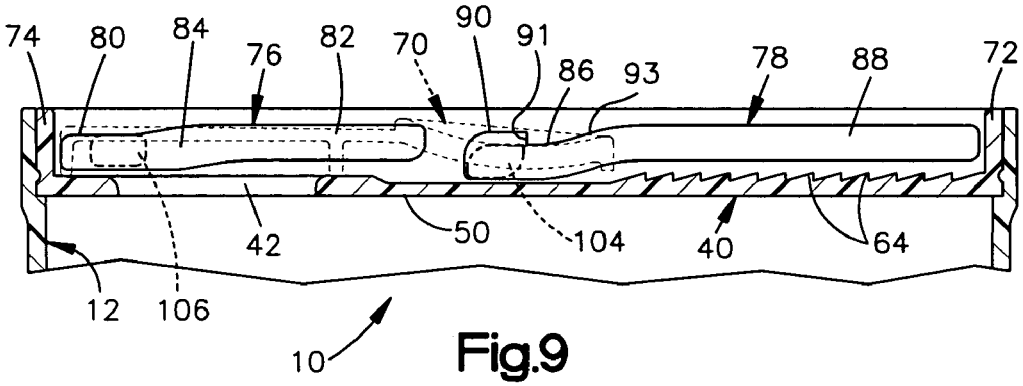
Figure 10:
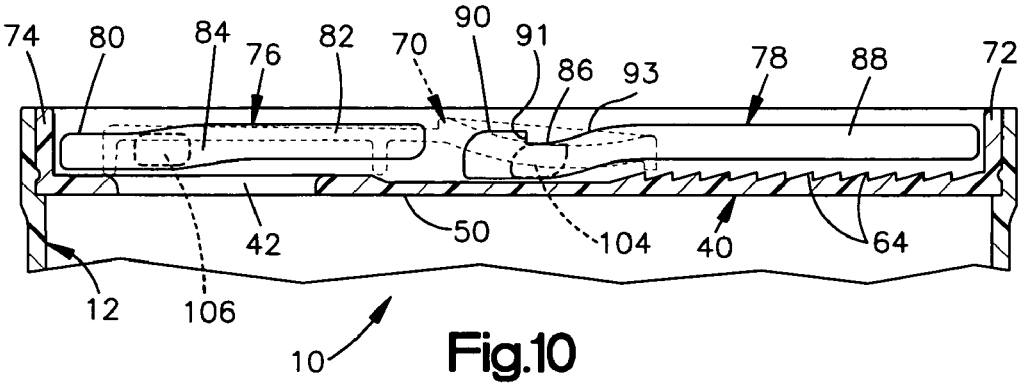
Figure 11:
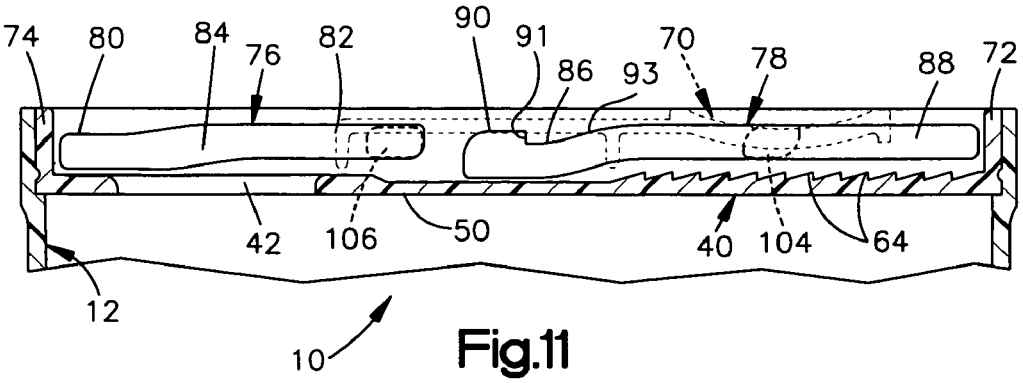

FIGS. 4 and 8 illustrate the parts of the package 10 in a closed condition exhibiting the original seal of the package. When the package 10 is in the original sealed condition, the slide 90 covers the access opening 42 in the main body panel 50 of the plug 40. The sealing surface 102 on the underside of the slide 90 engages the rim 60 surrounding the access opening 42, to close the access opening.

The detachable member 110 is connected with the slide 90 by the bridge portions 116. The detachable member 110 is located forward of the slide 90, between the slide and the ratchet teeth 64. The detachable member 110 is engaged with the first few ratchet teeth 64. The pawls 116 on the detachable member 110 are oriented to enable sliding movement of the detachable member in one direction only relative to the ratchet teeth 64—that is, a forward or opening direction (to the right as viewed in FIGS. 4–7).

The front tracking pins 104 on the slide 90 (FIG. 8) are located in the raised back end portions 90 of the front tracks 78 on the plug 40. The tracking pins 104 are in engagement with the shoulders 91 on the side walls of the plug 40. This engagement of the tracking pins 104 with the shoulders 91 blocks movement of the slide 90 in a forward direction. The access opening 42 can not be uncovered except as described below. As a result, the closure 14 is child-resistant.

To move the slide 90 to uncover the access opening 42, the user applies force to the finger grip 98 in a direction inward or downward, that is, toward the interior of the container 12. This is the "Push Down" movement noted in the indicia 96 on the outer side surface 94 of the slide 90.

This downward force has three effects. First, the slide 90 deforms (FIG. 5), ending so that the part of it that is forward of the sealing surface 102 moves down.

Second, as the slide 90 deforms, it breaks off from the detachable member 110, rupturing the bridge portions 116. This breaking action creates an audible snapping sound, indicating to the user that the original seal of the package 10 is being broken.

Third, the front tracking pins 104 of the slide 90 (FIG. 9) move out of the raised back end portions 90 of the front guidance tracks, and out of engagement with the shoulders 91. As a result, the slide 90 is free to move forward.

The user then applies force to the finger grip 98 in a direction not only inward or downward, but also forward. This force causes the slide 90 (FIG. 6) to move along the plug 40 in a direction along the axis 44. The front tracking pins 104 of the slide 90 (FIG. 10) move from the back portions 90 of the front tracks 78 outward into the forward portions 88 of the front tracks, as shown sequentially in FIGS. 4–6. The back tracking pins 106 of the slide move 90 simultaneously along the back portions 84 of the back tracks 76 and outward into the front portions 82 of the back tracks, as shown sequentially in FIGS. 4–6. This is the "& Slide" movement noted in the indicia 96 on the outer side surface 94 of the slide 90. As this axial sliding movement occurs, the slide 90 moves outward, that is, away from the interior of the container 12, by a small amount.

Figure 6:
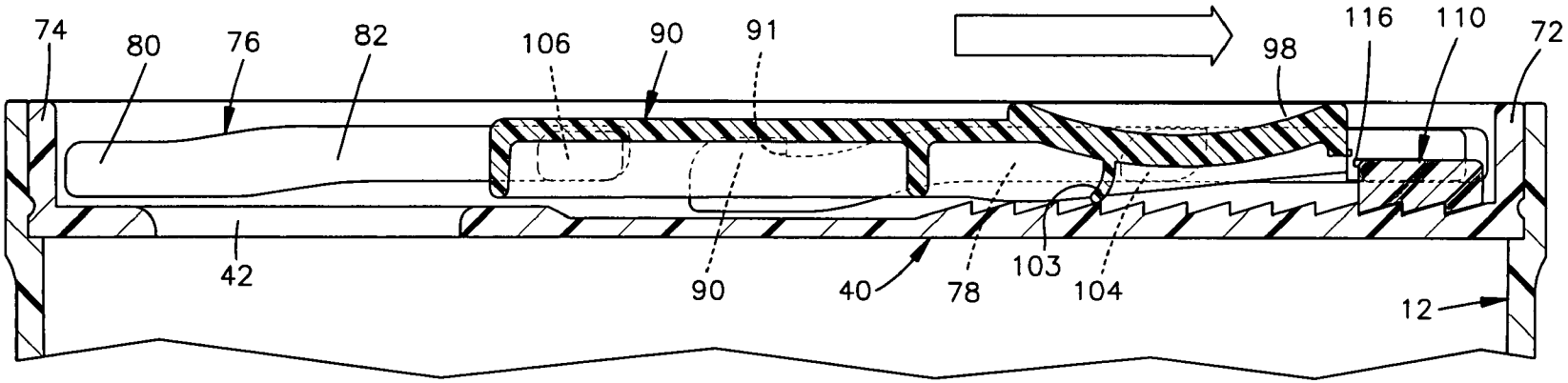
FIG. 6 is a sectional view similar to FIG. 4 showing the closure in a third condition, fully opened.
Figure 7:
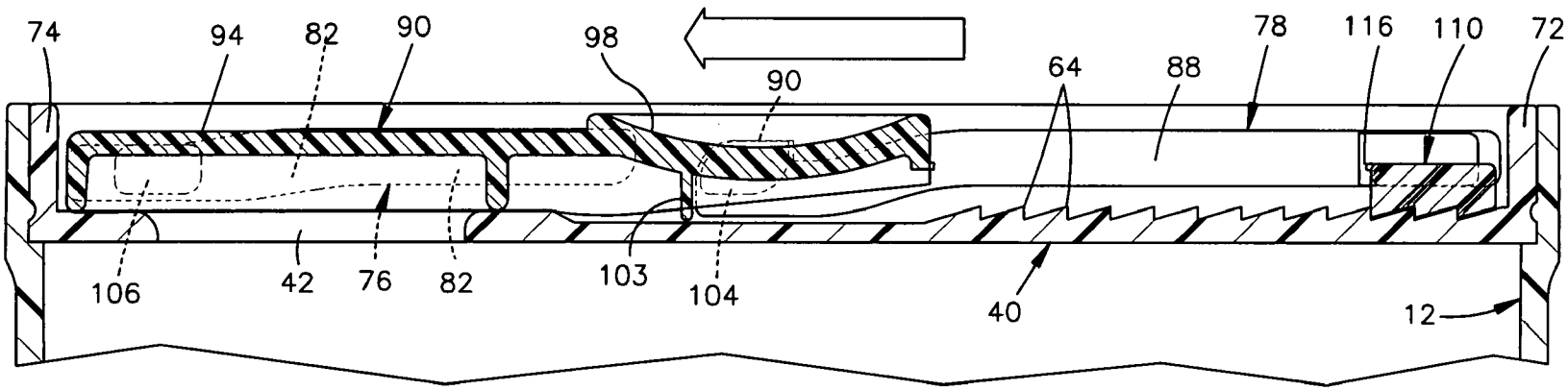
FIG. 7 is a sectional view similar to FIG. 4 showing the closure in a fourth condition, closed.

The detachable member 110 is pushed forward by the moving slide 90. The pawls 116 on the detachable member 110 ride along the ratchet teeth 64 of the plug 40. The slide 90 (FIG. 7) is moved forward to the end of its travel, to a fully open position as shown in Fig. In this position, the access opening 42 is completely uncovered. The user has full access to the medication inside the container 12. The package 10 is in a fully opened condition as shown in FIG. 7). The detachable member 110 is located at the forward end of the array of ratchet teeth 64, as shown in FIG. 6.

As the slide 90 moves from the closed position toward the open position, the finger 103 on the underside of the slide rides along the tips of the ratchet teeth 64. This engagement of the finger 103 with the ratchet teeth 64 generates an audible clicking sound, which indicates that the package 10 is being opened. This sound is generated every time the package 10 is opened, not merely when the original seal is being broken.

To return the package 10 to its closed condition, the slide 90 (FIG. 7) is moved back to its original closed position overlying the access opening 42. This is done by exerting a front to back pushing force on the finger grip portion 98 of the slide 90, in the opposite direction as was used to open the package 10. The force causes the slide 90 to move back toward its closed position.

As the slide 90 moves from the open position toward the closed position, the finger 103 on the underside of the slide engages and slides along the tips of the ratchet teeth 64. This engagement of the finger 103 with the ratchet teeth 64 generates an audible clicking sound, which indicates that the package 10 is being closed. This sound is generated every time the package 10 is closed, not merely the first time.

The front tracking pins 104 of the slide 90 move along the front tracks 78, down the ramp portions 93 from the front portions 88 of the front tracks to the back portions 90 of the front tracks. At the same time, the back tracking pins 106 of the slide 90 move along the back tracks 76, down the ramp portions 80 from the front portions 82 of the back tracks into the back portions 80 of the back tracks. The sealing surface 102 on the underside of the slide 90 moves into abutting engagement with the access opening rim 60 on the thicker portion 54 of the base panel 50 of the plug 40, sealing off the access opening 42.

When the slide 90 reaches its limit of travel in the closing direction (FIG. 4), the slide resiliently returns to its original shape, and the front tracking pins 104 on the slide move rapidly upward into the raised back end portions 90 of the front tracks 78. This movement generates an audible snap sound to indicate to the user that the slide 90 is in the closed position. The front tracking pins 104 are in engagement with the shoulders 91, resisting opening of the closure 14.

When the slide 90 moves from the open position to the closed position, the detachable member 110 does not move with the slide. The detachable member 110 is no longer connected to the slide 90 for movement with the slide, and the engagement of the pawls 116 of the detachable member with the ratchet teeth 64 of the plug 40 prevents such movement. The detachable member 110, instead, stays in its position at the forward end of the plug 40. This position is maintained for the life of the package 10, and indicates that the original seal of the package has been broken. As a result, the interaction of the detachable member 110 and the plug 40 serves as a tamper-evident feature of the package 10.

It should be understood that the tamper-resistant feature of the present invention could be configured somewhat differently. Specifically, the detachable member 110 can be configured so to be physically not connected with the slide 90 when the package 10 has its original seal. In that case, the initial movement of the slide to the open position would move the member 110 but would not cause it to detach from the slide. The member 110 would remain at the front end of the plug when the closure 14 is first opened.

The package 10 can be opened to any one of a plurality of different open positions. The slide 90 does not need to be moved completely to the end of its travel, as shown in FIG. 6, every time the package 10 is opened. Instead, the slide 90 can be moved partially along the plug 40, uncovering the access opening 42 to a greater or lesser extent. The engagement of the finger 103 with the tops of the ratchet teeth 64 holds the slide 90 in the selected position while the contents of the container 12 are being accessed. The finger 103 thus acts as a retainer that holds the container partially open. This can enable removal of smaller pills, or fewer pills, than opening the container completely.

Figure 14:
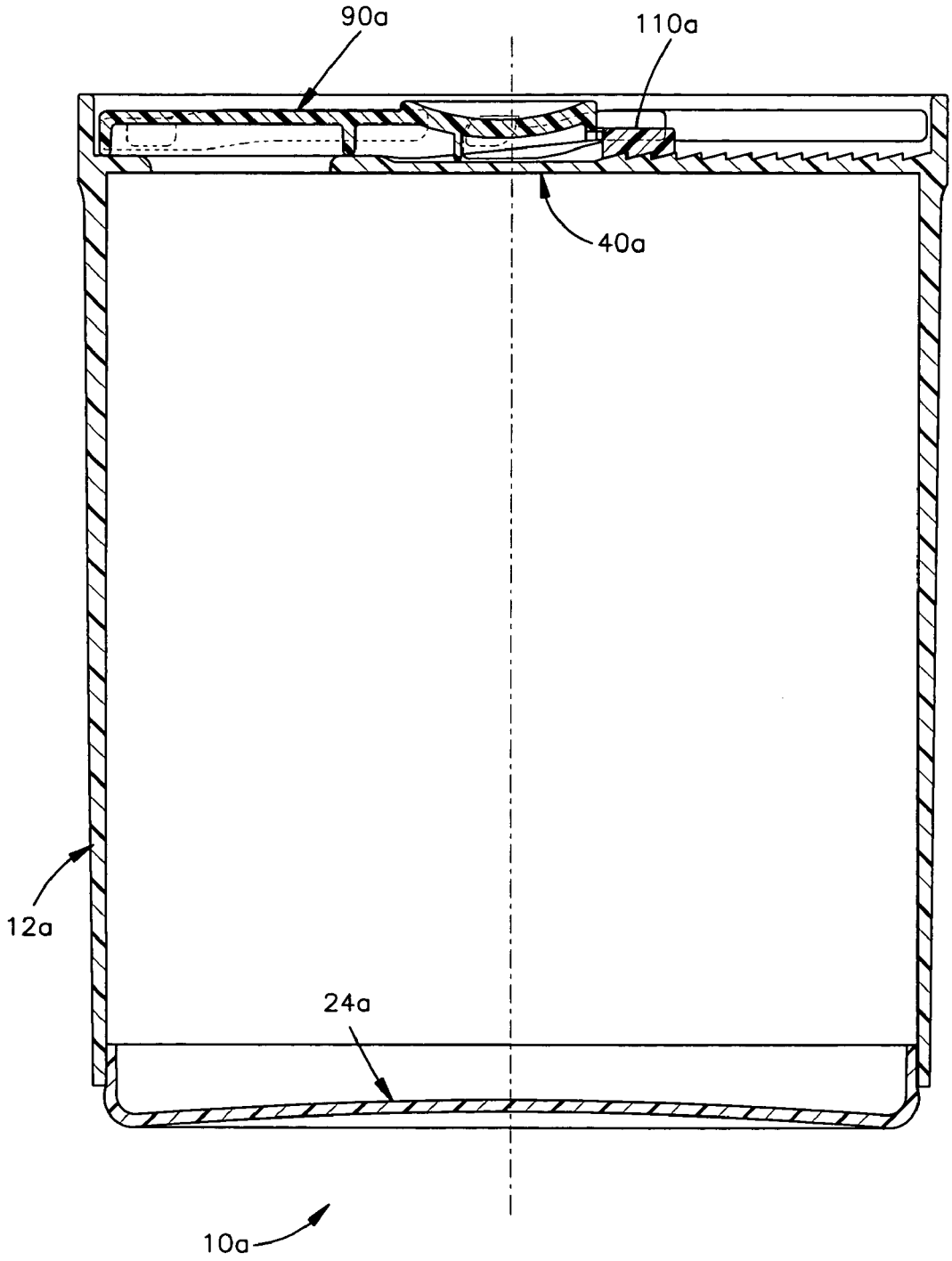
FIG. 14 is a sectional view similar to FIG. 2 showing a container and closure in accordance with a second embodiment of the invention.

FIG. 14 illustrates a package 10*a* in accordance with a second embodiment of the invention. The package 10*a* is similar to the package 10, and parts that are the same or similar are given the same reference numerals with the suffix "a" attached.

In the package 10*a*, the container 12*a* has an open bottom. A bottom wall plug 24*a* is formed separately and is sealed to the container 12*a* after the container is filled. The dispensing plug 40*a* is formed as one piece with the container 12*a*. The dispensing plug 40*a* thus forms the top wall of the container 12*a*, even before the container is filled. The dispensing plug 40*a* is a part of a closure that closes the top end of the container 12*a*. The plus 40*a* is attached to the other parts of the container (other than the bottom wall plug 24*a*) as one piece during manufacture of the container 12*a*. The slide 40*a* and the detachable member 110*a*, which are the other parts of the closure, are assembled to the plug 40*a* in the same manner, and interact with the plug 40*a* in the same manner, as described above with reference to the first embodiment of the invention.

Having described the invention, we claim:

1. A package containing and dispensing medicine, comprising:

a container sized to contain medicine for a patient, the container having an original seal; and a child-resistant closure to close the container, including a plug having an access opening for the medicine, the closure being openable to break the original seal and also openable thereafter only by the application of two dissimilar, simultaneous motions;

the closure including a slide that is slidable in a first direction along the plug from a closed position to an open position, the slide when in the closed position closing the access opening and having pins that engage shoulders on the plug to block sliding movement of the slide along the plug in the first direction;

the slide being movable into a released position by the application of force in a second direction different from the first direction so that the pins of the slide move away from the shoulders of the plug thereby to enable sliding movement of the slide along the plug in the first direction;

the slide being slidable out of the released position by the application of force in the first direction simultaneous with the application of force in the second direction.

2. A package as set forth in claim 1 wherein the slide is formed as one piece with a detachable member that breaks off the slide when the slide is moved from the closed position to the released position, on opening of the package to break the original seal of the package.

3. A package as set forth in claim 2, wherein the breaking off of the detachable member creates an audible snapping sound as an indication that the original seal of the package is being broken.

4. A package as set forth in claim 2 comprising a plurality of ratchet teeth on the plug that are engaged by a portion of the slide as the slide moves between the open and closed positions to provide an audible sound indicating opening of the closure, the ratchet teeth being engaged by the detachable member as the slide moves from the closed position to the open position, the ratchet teeth enabling sliding movement of the detachable member in the first direction and preventing movement of the detachable member with the slide when the slide is returned to the closed position.

5. A package as set forth in claim 4 wherein the ratchet teeth resist movement of the slide in either direction along the plug thereby to help control positioning of the slide and retain the slide in any selected one of a plurality of open positions.

6. A package as set forth in claim 2 wherein the slide and the detachable member remain connected with the plug after the detachable member detaches from the slide.

7. A package as set forth in claim 1 wherein the slide is made of a resilient material so that the slide snaps back into the closed position when moved from the open position past the shoulders on the plug.

8. A package as set forth in claim 1 wherein the container has a generally rectangular configuration including at least one generally flat side surface large enough for placement of a mailing address label; an address label on the side surface; and further including a sealable mailer envelope for receiving the medicine container, the mailer envelope having a transparent window through which the address label on the container is visible when the container is received in the mailer envelope.

9. A package as set forth in claim 8 wherein the rectangular container further has a flat spine surface large enough for placement of medicine identifying information visible to the patient when the package is stored.

10. A package as set forth in claim 1 including teeth on the plug that are engaged by a portion of the slide as the slide moves between the open and closed positions to provide an audible sound indicating sliding movement of the slide, the teeth resisting movement of the slide in either direction along the plug thereby to help control positioning of the slide and retain the slide in any selected one of a plurality of open positions.

* * * * *